US011473463B1

(12) United States Patent
Motey

(10) Patent No.: US 11,473,463 B1
(45) Date of Patent: Oct. 18, 2022

(54) TAILPIPE APPARATUS TO CAPTURE GREENHOUSE GAS EMISSIONS

(71) Applicant: Alexander Kian Motey, Los Altos, CA (US)

(72) Inventor: Alexander Kian Motey, Los Altos, CA (US)

( * ) Notice: Subject to any disclaimer, the term of this patent is extended or adjusted under 35 U.S.C. 154(b) by 64 days.

(21) Appl. No.: 17/555,465

(22) Filed: Dec. 19, 2021

Related U.S. Application Data

(60) Provisional application No. 63/264,368, filed on Nov. 21, 2021, provisional application No. 63/237,461, filed on Aug. 26, 2021, provisional application No. 63/229,952, filed on Aug. 5, 2021, provisional application No. 63/187,876, filed on May 12, 2021, provisional application No. 63/135,850, filed on Jan. 11, 2021.

(51) Int. Cl.
*F01N 3/021* (2006.01)
*F01N 3/08* (2006.01)
*F01N 13/08* (2010.01)

(52) U.S. Cl.
CPC ..... *F01N 3/0211* (2013.01); *F01N 3/0217* (2013.01); *F01N 3/0821* (2013.01); *F01N 3/0857* (2013.01); *F01N 13/082* (2013.01); *F01N 2450/26* (2013.01)

(58) Field of Classification Search
CPC ..... F01N 13/082; F01N 3/023–0233; F01N 3/0821; F01N 3/021–035; F01N 2230/02; F01N 2250/02; F01N 2250/14; F01N 2330/00; F01N 2330/12; F01N 2330/22; F01N 2350/00; F01N 2450/26; F01N 2450/30; B01J 2219/00909; B01J 2219/2424
USPC ..... 60/311; 422/616
See application file for complete search history.

(56) References Cited

U.S. PATENT DOCUMENTS 3,869,267 A * 3/1975 Gaylor ..... F01N 3/0211 55/505
3,988,113 A * 10/1976 Roberts ..... F01N 13/1894 422/177
7,278,259 B2 10/2007 Schmeichel et al.
(Continued)

FOREIGN PATENT DOCUMENTS

CN 101663470 B 12/2013
CN 204572135 U 8/2015
(Continued)

OTHER PUBLICATIONS

Aramco web page, https:// www.aramco.com/en/creating-value/technology-development/transport-technologies/mobile-carbon-capture, 2021.
(Continued)

*Primary Examiner* — Mickey H France
(74) *Attorney, Agent, or Firm* — Clause Eight; Michael Catania

(57) ABSTRACT

An apparatus for attachment to a tailpipe of a vehicle is disclosed herein. The apparatus includes a filter body, a removable filter medium, a locking collar and a removable front cover. The filter medium preferably comprises of any materials that are deemed by the scientific community as sorbents that are capable of absorbing exhaust gases such as carbon dioxide, nitrogen oxides, carbon monoxide, sulfur dioxide, particulate matter, or other hydrocarbons.

22 Claims, 22 Drawing Sheets

(56) References Cited

U.S. PATENT DOCUMENTS

| | | | | |
|---|---|---|---|---|
| 7,785,544 | B2 | 8/2010 | Alward et al. | |
| 9,486,733 | B2 | 11/2016 | Hamad | |
| 10,823,024 | B2 | 11/2020 | Chidubem et al. | |
| 2007/0084199 | A1* | 4/2007 | Whitaker | F01N 13/082 60/297 |
| 2018/0313242 | A1* | 11/2018 | Chidubem | F01N 3/0211 |
| 2020/0248600 | A2* | 8/2020 | Chidubem | F01N 3/0211 |
| 2021/0140355 | A1* | 5/2021 | Chidubem | F01N 3/0215 |

FOREIGN PATENT DOCUMENTS

| | | | |
|---|---|---|---|
| CN | 105402013 | A | 3/2016 |
| CN | 205225388 | U | 5/2016 |
| CN | 111346511 | A | 6/2020 |
| CN | 210858905 | U | 6/2020 |
| EP | 2962744 | | 11/2019 |

OTHER PUBLICATIONS

Sullivan et al., Carbon Capture in Vehicles: A Review of General Support, Available Mechanisms, and Consumer-Acceptance Issues, The University of Michigan Transportation Research Institute, Report No. UMTRI-2012-12, May 2012.

Meng et al., Highly active oxygen evolution integrated with efficient CO2 to CO electroreduction, PNAS, vol. 116, No. 48, 23915-23922, Nov. 26, 2019.

Vieille et al., Improvements of calcium oxide based sorbents for multiple C)2 capture cycles, Powder Technology, Elsevier, 2012, pp. 319-323.

Pall Water, Nexis A Series Filter Cartridges, 2020.

Rajdurai et al., CO2 Capture Using Activated Alumina in Gasoline Passenger Vehicles, Journal of Engineering Research and Applications, vol. 6, Issue 5, (Part 4), pp. 73-77 May 2016.

Selvanathan et al., Emissions Control of Engines Using Limestone and Water Mixture, Journal of Science Engineering & Technology, vol. 4, No. 2, Jun. 2017.

Adaileh et al., Reduction of the Spark ignition Engine Emissions Using Limestone Filter, SENRA Academic Publishers, British Columbia, vol. 8, No. 1, pp. 2761-2767, Feb. 2014.

Coelho et al., Stability of an Al-Fumarate MOF and its Potential for CO2 Capture From Wet Stream, I&EC Research, 55, 2134-2143, 2016.

Abraha et al., Optimized CO2 Capture of the Zeolitic Imidazaolate Framework ZIF-8 Modified by Solvent-Assisted Ligand Exchange, ACS Omega, 6, 21850-21860, 2021.

Sumida et al, Carbon Dioxide Capture in Metal-Organic Frameworks, Chem. Rev., 112, 724-781, 2012.

Ding et al., How Well Do Metal-Organic Frameworks Tolerate Flue Gas, J. Phys. Chem. C, 116, 22987-22991, 2012.

Banerjee et al., High-Throughput Synthesis of Zeolitic Imidazaolte Frameworks and Application to CO2 Capture, Science, vol. 319, Feb. 15, 2008.

Phan et al., Synthesis, Structure, and Carbon Dioxide Capture Properties of Zeolitic Imidazaolate Frameworks, Accounts of Chemical Research, 58-67, vol. 43, No. 1, Jan. 2010.

Yoon et al., Co2/N2 Gas Separation Using Pebax/ZIF-7-Psf Composite Membranes, Membranes, 11, 708, Sep. 14, 2021.

Usman et al., Advanced Strategies in Metal-Organic Frameworks for CO2 Capture and Separation, Chem Rec, 21, 1-29, 2021.

Garcia-Mariaca et al., Review on Carbon Capture in ICE Driven Transport, Energies, 14, 6865, 2021.

Lin et al., A Scalable metal-organic framework as a durable physisorbent for carbon dioxide capture, Science 374, 1464-1469, Dec. 17, 2021.

* cited by examiner

TAILPIPE APPARATUS TO CAPTURE GREENHOUSE GAS EMISSIONS

CROSS REFERENCES TO RELATED APPLICATIONS

The Present Application claims priority to U.S. Provisional Patent Application No. 63/135,850, filed on Jan. 11, 2021, U.S. Provisional Patent Application No. 63/187,876, filed on May 12, 2021, U.S. Provisional Patent Application No. 63/229,952, filed on Aug. 5, 2021, U.S. Provisional Patent Application No. 63/237,461, filed on Aug. 26, 2021, U.S. Provisional Patent Application No. 63/264,368, filed on Nov. 21, 2021, each of which is hereby incorporated by reference in its entirety.

STATEMENT REGARDING FEDERALLY SPONSORED RESEARCH OR DEVELOPMENT

Not Applicable

BACKGROUND OF THE INVENTION

Field of the Invention

The present invention generally relates to vehicle tail pipe filter, and more specifically to vehicle tail pipe filters for capture of greenhouse gas emissions.

Description of the Related Art

Light-duty gasoline powered vehicles have been deployed everywhere for people to travel day by day to: complete their chores, get to and from work, and engage in personal activities. It has greatly enabled individual productivity from when the idea was first patented in 1886. This activity has also created a consequence of emitting greenhouse gases into Earth's atmosphere. Now, it is 2021 and our world is resolving what has become the climate crisis, where we have come together to reduce individual, corporate, and governmental greenhouse gas emissions to zero. Civilization has been able to thus far properly address reductions of greenhouse gas emissions from the production of: electricity, chemical reactions to produce goods from raw materials, energy, businesses and homes, maintenance of livestock, and usage of cars, trucks, planes, trains and ships. While our world has actively engaged itself to reduce emissions in all of these sectors through electrification, there seems to be one vital sector that is being left behind: further reduction of emissions from existing gasoline engaged light-duty vehicles.

The light-duty vehicle industry has actively sought to reduce its greenhouse gas emissions for decades. Research and development investments have gone into making an Earth friendly light-duty vehicle, such as improving the catalytic converter, replacing the internal combustion engine system with an electric system, or adding an electric based engine to the gasoline powered vehicle propulsion process. Gasoline-powered vehicles still produce significant emissions; and even if a more efficient catalytic converter or energy reducing engine system is created or improved, it won't be affordable to most people that currently own and operate a functioning gasoline powered vehicle, especially in regions where electric vehicle adoption rates are concerningly underwhelming.

As the vastly anticipated electrification of the light-duty vehicle industry is under way, major car companies have committed hundreds of billions of dollars thus far to electrify the world vehicle fleet. Currently, an estimated 1.2 billion cars on our roads are powered by fossil fuels. It is disastrously anticipated that still, new models in future years will still consume fossil fuels and produce greenhouse gas emissions.

Onboard carbon capture technology has become feasible for large internal combustion engines in industries such as maritime transport and heavy duty trucking. Attempts to capture carbon dioxide from the tailpipes of light-duty vehicles have been attempted before, but onboard conversion caused the entire process to be environmentally uneconomical. By capturing emissions at the tailpipe and converting the emissions using a conversion device unattached to the light duty vehicle, the environmental economics become feasible.

BRIEF SUMMARY OF THE INVENTION

The present invention provides a novel solution to removing exhaust from the gas-powered vehicles that are still used by the vast majority of drivers.

In one aspect of the present invention, zeolitic imidazole frameworks, zeolites, metal organic frameworks (MOFs), other hybrid ultra porous materials, membranes, adsorption focused materials, other natural sorbents or adsorbents, any salt containing: Li, Na, K, Cs, Rb, Fr, Ca, Mg, Be, Sr and Ba. Salts considered for this applications correspond to any alkali and alkaline earth element and: OH(—), NO3(-), SO3(-), SO4(2-), CO3(2-), CN(—), PO3(2-), CH3COO(—), PO4(3-), HPO4(2-), H2PO4(-), HCO3(-) and S(2-), is placed inside of a filter apparatus that shrinks the exit area of exhaust gases from vehicle tailpipes. The sorbent inside of the apparatus can absorb/adsorb incoming carbon dioxide. The Present Invention is possibly able to marginally reduce carbon dioxide emissions of vehicles without lowering the MPG of the vehicle.

Another aspect of the present invention is an apparatus for attachment to a tailpipe of a vehicle. The apparatus comprises a filter body, a removable filter medium, a locking collar and a removable front cover. The filter body comprises a front flange with an aperture and an elongated section configured for insertion into the tailpipe. The filter body has a thickness ranging from 0.1 to 0.5 inch. The filter body has a length ranging from 1 to 24 inches, and a diameter of 1 to 7 inches. The removable filter medium placed within the elongated section of the filter body. The locking collar configured for placement on an exterior of the tailpipe. The removable front cover positioned over the aperture of the front flange of the filter body. The filter body is secured to the tailpipe by connection of the front flange to the locking collar. Exhaust from a tailpipe reacts with the filter medium. A mass of the apparatus ranging from 1 to 25 pounds.

Yet another aspect of the present invention is an apparatus for attachment to a tailpipe of a vehicle. The apparatus comprises a filter body, a removable filter medium, a collar and a removable front cover. The filter body comprises a front section with an aperture, an elongated section configured for insertion into the tailpipe, and a rear cover attached to an interior end of the elongated section. The filter body has a thickness ranging from 0.1 to 0.5 inch. The filter body has a length ranging from 1 to 24 inches, and a diameter of 1 to 7 inches. The removable filter medium is placed within the elongated section of the filter body. The collar is configured for placement on an exterior of the tailpipe. The removable front cover positioned over the aperture of the flange section of the filter body. The filter body is secured to the tailpipe by connection of the front section to the collar. Exhaust from a tailpipe is absorbed by the filter medium. A mass of the apparatus ranging from 1 to 25 pounds.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1A:
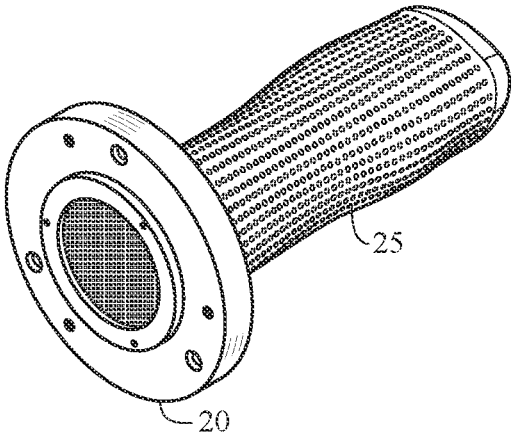
FIG. 1A is a top perspective view of a tailpipe filter.
Figure 1B:
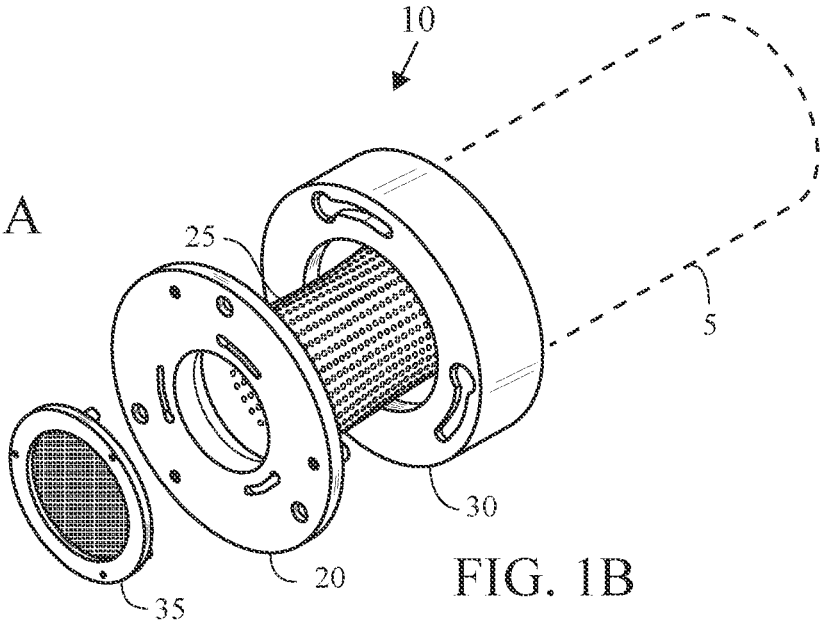
FIG. 1B is an exploded top perspective view of a tailpipe filter within a tailpipe.
Figure 1C:
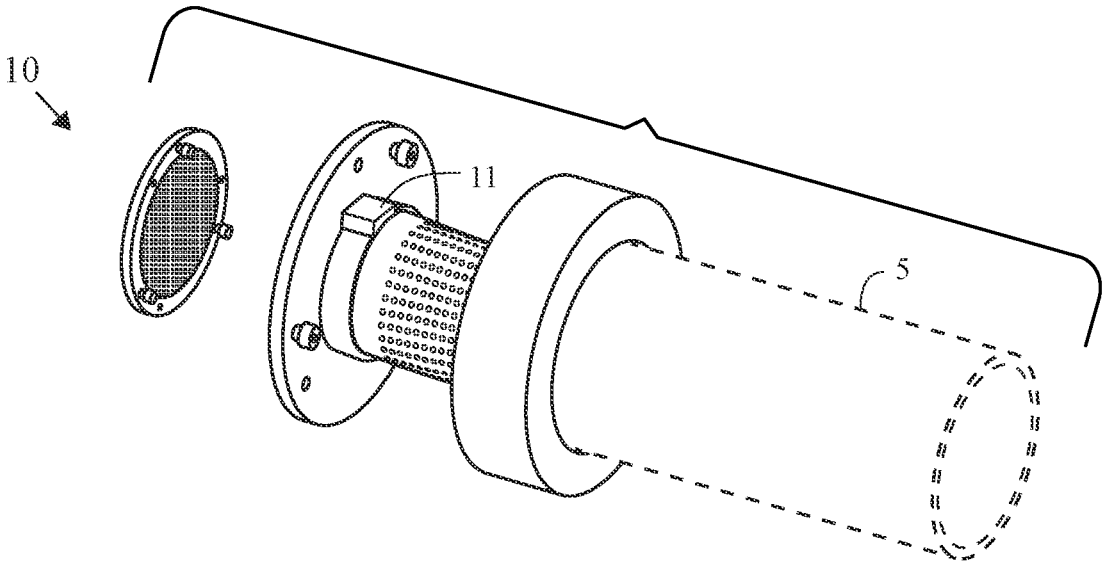
FIG. 1C is an exploded top perspective view of a tailpipe filter within a tailpipe.
Figure 2A:
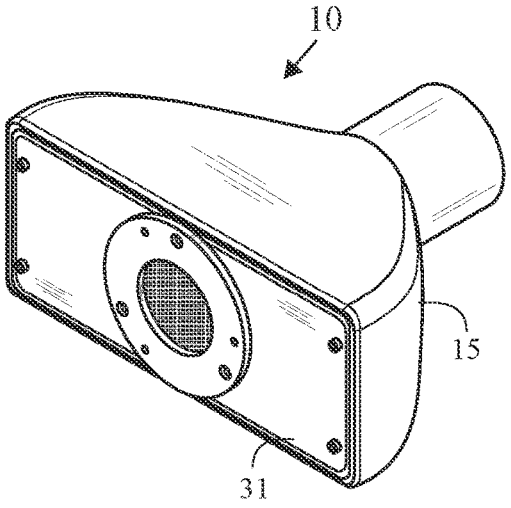
FIG. 2A is a top perspective view of an alternative embodiment of a tailpipe filter within a rectangular tailpipe.
Figure 2B:
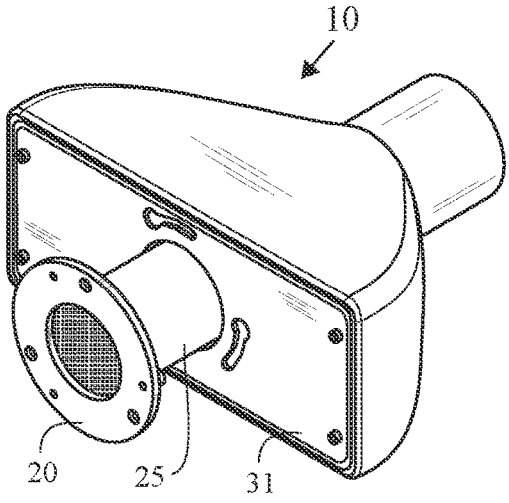
FIG. 2B is a top perspective view of an alternative embodiment of a tailpipe filter within a rectangular tailpipe.
Figure 2C:
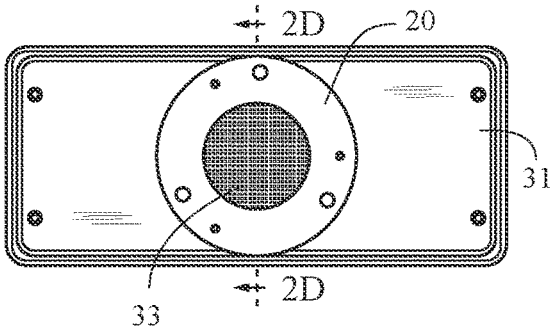
FIG. 2C is a front elevation view of an alternative embodiment of a tailpipe filter within a rectangular tailpipe.
Figure 2D:
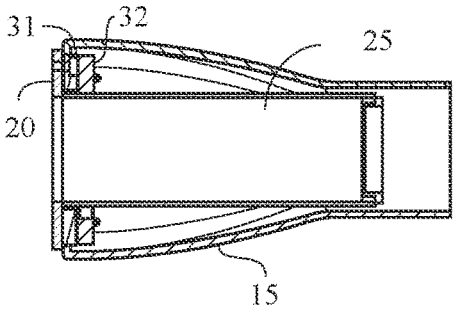
FIG. 2D is a cross-sectional view of a tailpipe filter along line 2D of FIG. 2C.
Figure 2E:
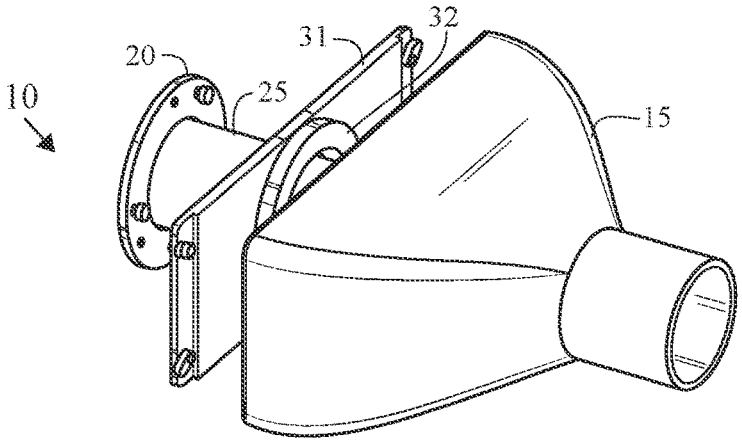
FIG. 2E is an exploded view of an alternative embodiment of a tailpipe filter within a rectangular tailpipe.
Figure 3A:
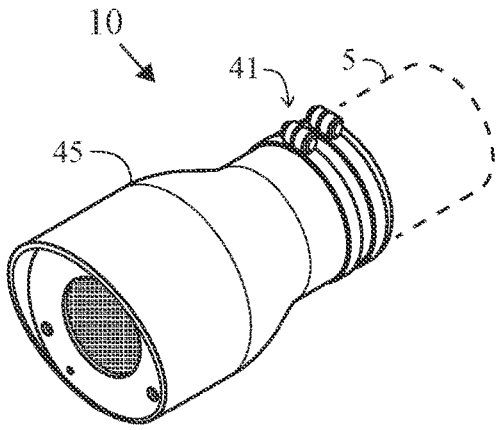
FIG. 3A is a top perspective view of an alternative embodiment of a tailpipe filter.
Figure 3B:
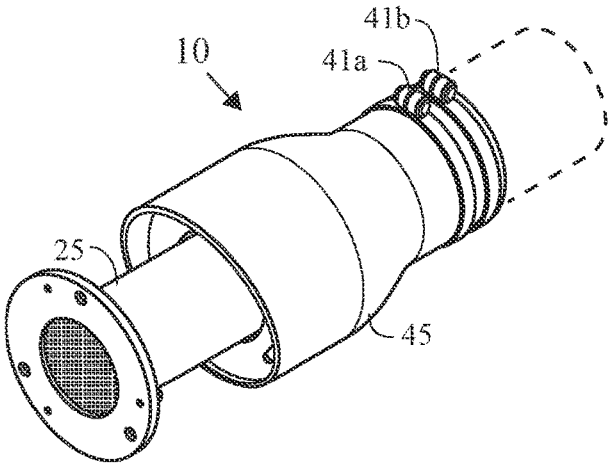
FIG. 3B is a top perspective view of an alternative embodiment of a tailpipe filter.
Figure 3C:
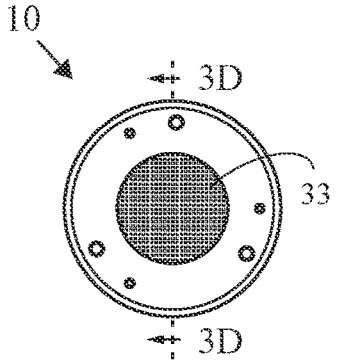
FIG. 3C is a front elevation view of an alternative embodiment of a tailpipe filter with a decorative tip.
Figure 3D:
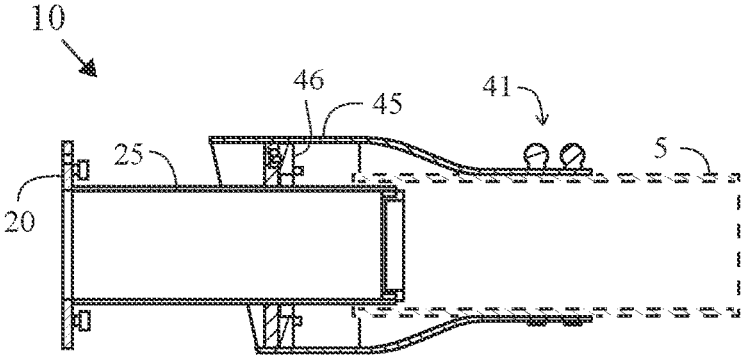
FIG. 3D is a cross-sectional view of a tailpipe filter along line 3D of FIG. 3C.
Figure 4A:
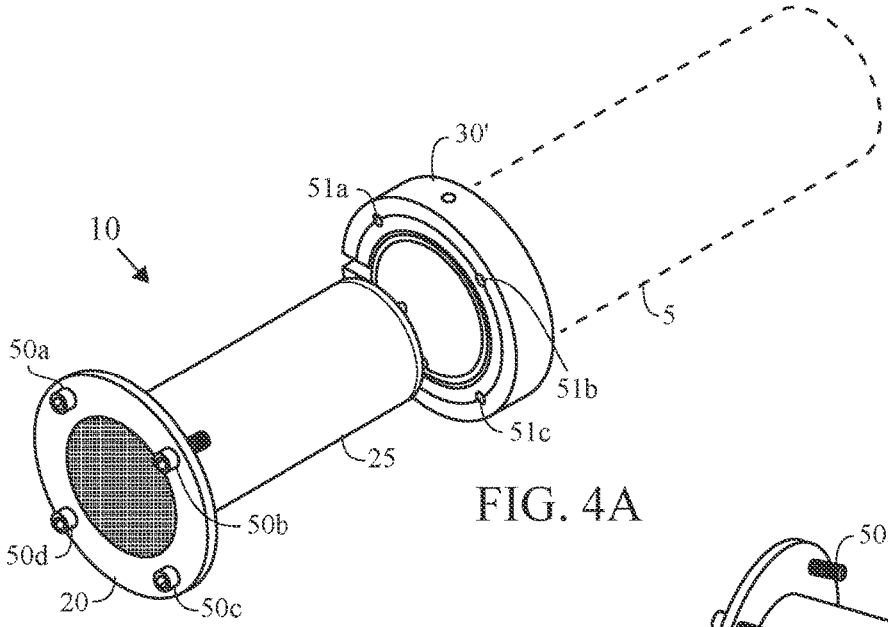
FIG. 4A is a top perspective view of an alternative embodiment of a tailpipe filter.
Figure 4B:
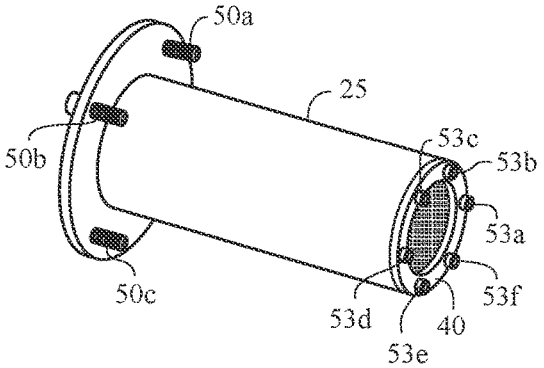
FIG. 4B is a top perspective view of an alternative embodiment of a tailpipe filter.
Figure 4C:
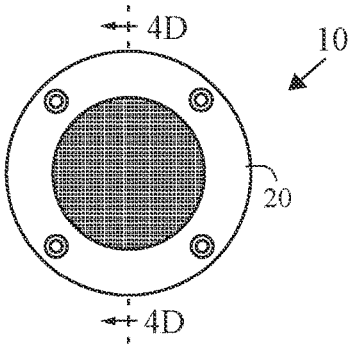
FIG. 4C is a front elevation view of an alternative embodiment of a tailpipe filter within a rectangular tailpipe.
Figure 4D:
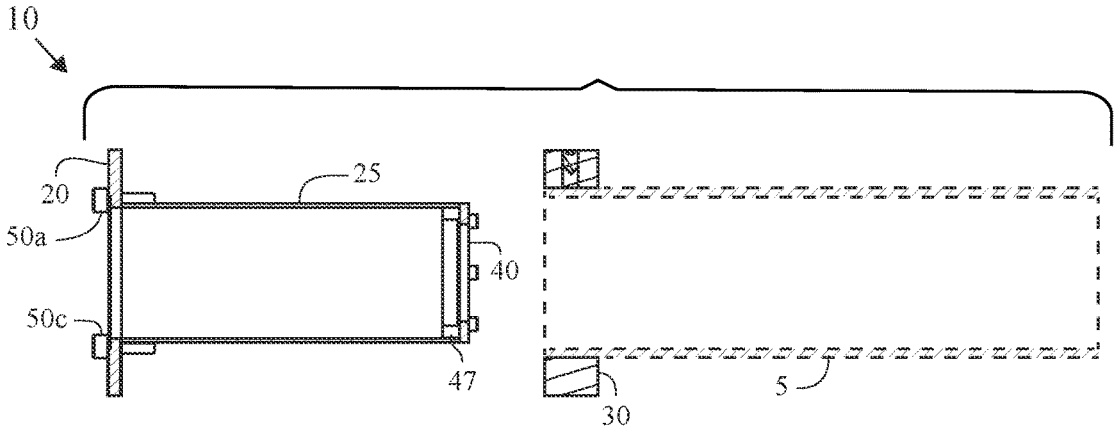
FIG. 4D is a cross-sectional view of a tailpipe filter along line 4D of FIG. 4C.

FIGS. 1A-1C illustrate a preferred embodiment of an apparatus 10 utilized in a tailpipe 5 of a gas-powered motor vehicle. The apparatus 10 preferably comprises a filter body 25 with a front flange 20 with an aperture and an elongated section configured for insertion into the tailpipe 5 of a motor vehicle. The apparatus 10 also includes a locking collar 30 that is placed over a tailpipe 5 and engages the front flange 20 for locking the filter body 25 within the tailpipe 5. The apparatus 10 also includes a removable front cover 35 positioned over the aperture of the front flange 20 of the filter body 25. The filter body is preferably attached to the front flange 20 with a band clamp 11.

In a preferred embodiment, the filter body 25 is a mesh filter with a metal weaved screen with the density of the weave dependent on a filter medium diameter. Alternatively, the filter body 25 is a mesh filter with flexible perforated metal, with the size of the holes dependent on a filter medium diameter.

The front cover 35 is preferably a perforated sheet. The front cover 35 has shoulder bolts for placement within corresponding slots of the front flange 20 for locking the front cover 35 in place over the aperture of the filter body 25 using a twist-lock feature.

The front flange 20 has multiple locking bolts for placement within corresponding slots of the locking collar 30 for locking the front flange 20, with filter body 25, in place around the tailpipe 5 using a twist-lock feature.

The removability of the filter body 25 from the apparatus 10 allows for the replacement of the filter medium of the filter body 25 after use removing exhaust from the tailpipe 5 before the exhaust is emitted into the environment.

The flexible metal mesh material of the filter body 25 allows for insertion into tailpipes 5 with complex shapes. Once the apparatus 10 is installed, exhaust gases are forced through and interact with the filter medium of the filter body 25.

FIGS. 2A-2E illustrate an alternative embodiment of an apparatus 10 utilized in a tailpipe with a decorative tip 15 of a gas-powered motor vehicle. In this embodiment, the decorative tip 15 is rectangular in shape. A rectangular cover plate 31 of the apparatus 10 is secured to the decorative tip 15 of the tailpipe of the vehicle using a locking mechanism specific to the decorative tip 15. The cover plate 31 has a locking collar 32 on an interior surface. The filter body 25 is inserted through an access hole of the cover plate 31 and locking bolts of the front flange 20 are placed within corresponding slots of the cover plate 31 and locking collar 32 for securing the filter body 25 with the front flange 20 to the tailpipe using a twist lock mechanism. The front flange 20 preferably has a perforated screen 33 over the aperture of the filter body 25.

FIGS. 3A-3D illustrate an alternative embodiment of the apparatus 10. In this embodiment, the apparatus 10 includes a decorative tip 45 that is clamped to a tailpipe 5 using multiple clamps 41. The decorative tip 45 has an internal collar 46 for engaging and securing the filter body 25 within the tailpipe 5. Locking bolts of the front flange 20 are placed within corresponding slots of the internal collar 46 for securing the filter body 25 with the front flange 20 to the decorative tip 45 using a twist lock mechanism.

Figure 6A:
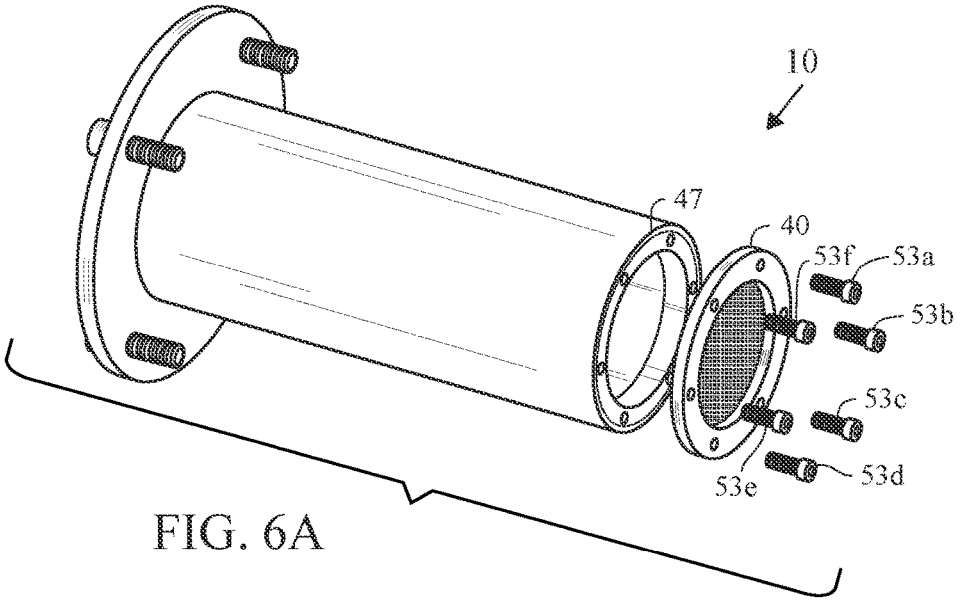
FIG. 6A is a top perspective exploded view of a tailpipe filter.
Figure 6B:
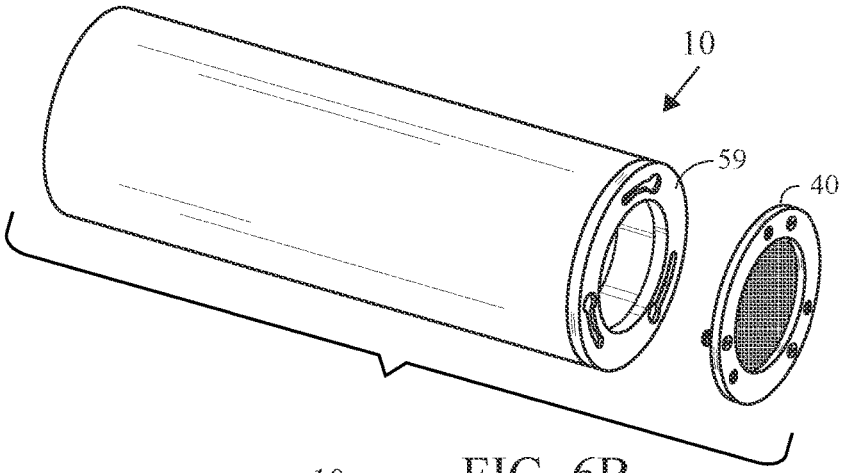
FIG. 6B is a top perspective exploded view of a tailpipe filter.
Figure 6C:
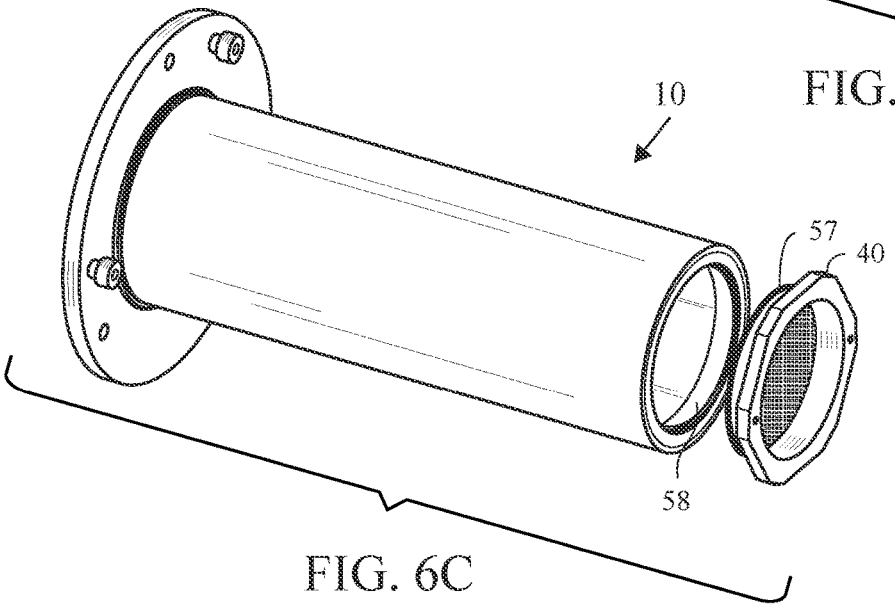
FIG. 6C is a top perspective exploded view of a tailpipe filter.

FIGS. 4A-4D illustrate an alternative embodiment of the apparatus 10. In this embodiment, the apparatus 10 has a front flange 20 with threaded bolts 50*a*-50*d* that threadingly engage corresponding threaded holes 51*a*-51*d* of the locking collar 30' for securing the filter body 25 within the tailpipe 5. In this embodiment, the filter body 25 has a removable rear cover 40 for removing the filter medium from the filter body 25. The removable rear cover 40 is secured to the filter body 25 in multiple mechanisms. One mechanism, as shown in FIG. 6A, is the use of the threaded rear cover bolts 53*a*-53*f* that engage with corresponding threaded holes on a welded ring 47 within the filter body 25. Another mechanism, as shown in FIG. 6C, is a threaded removable rear cover 40 that has external threads 57 around an internal perimeter of the removable rear cover 40 that threadingly engage corresponding internal threads 58 of the filter body 25. Yet another mechanism, as shown in FIG. 6B, is the use of locking bolts on the removable rear cover 40 that engage corresponding slots of an internal rear flange 59 of the filter body 25.

Figure 5A:
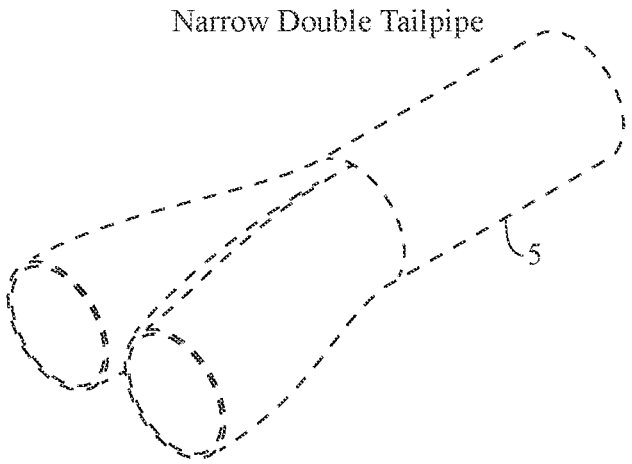
FIG. 5A is a top perspective of a narrow double tailpipe.
Figure 5B:
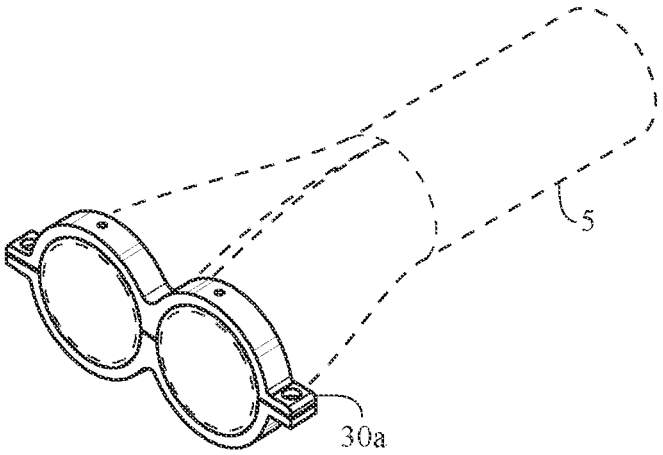
FIG. 5B is a top perspective of an alternative embodiment of tailpipe filter in a narrow double tailpipe.
Figure 5C:
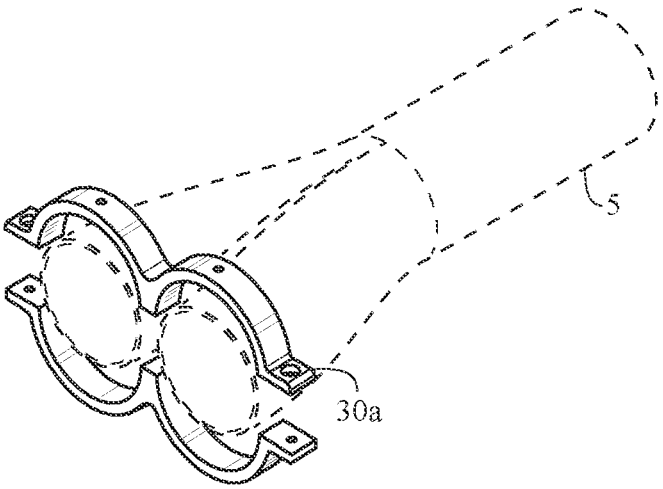
FIG. 5C is a top perspective of an alternative embodiment of tailpipe filter in a narrow double tailpipe.
Figure 5D:
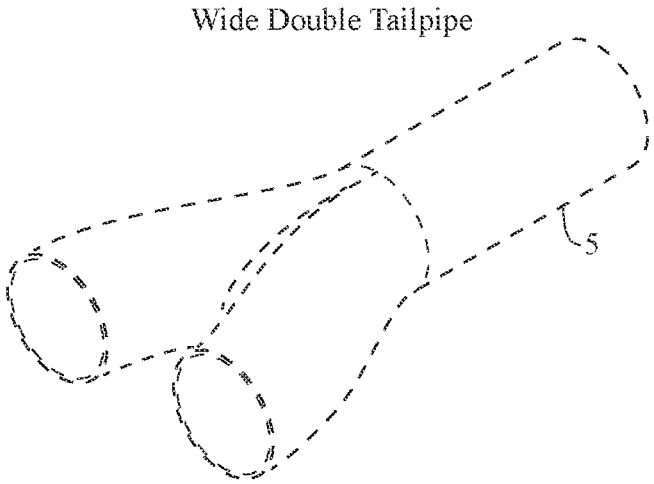
FIG. 5D is a top perspective of a wide double tailpipe.
Figure 5E:
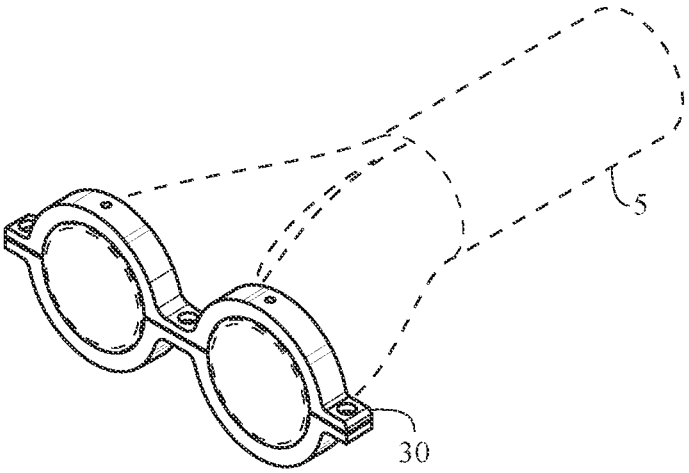
FIG. 5E is a top perspective of an alternative embodiment of tailpipe filter in a wide double tailpipe.

FIGS. 5A-5C illustrate an embodiment for a narrow double tailpipe 5, and FIGS. 5D-5E illustrate an embodiment for a wide double tailpipe 5. In these embodiments, a double locking collar 30*a* is utilized with two filter bodies 25 (not shown), and attached as described above.

Figure 7A:
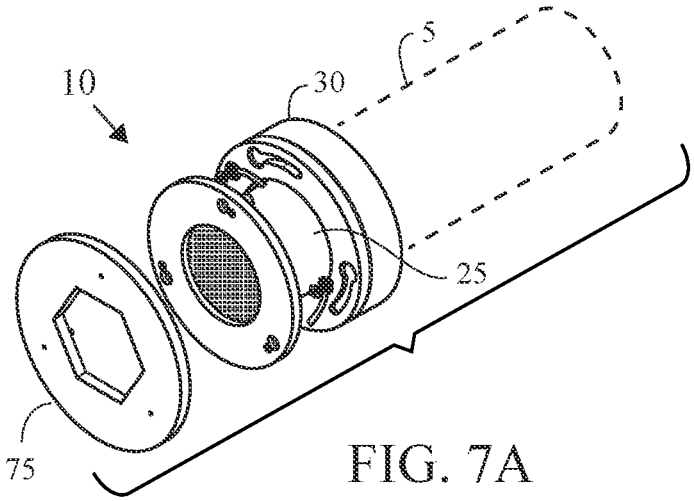
FIG. 7A is a top perspective exploded view of a tailpipe filter.
Figure 7B:
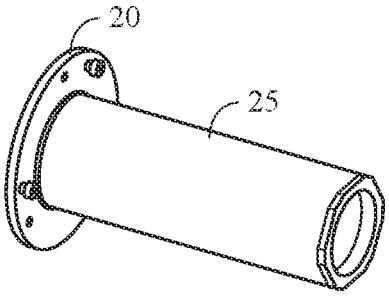
FIG. 7B is a top perspective view of a tailpipe filter.
Figure 7C:
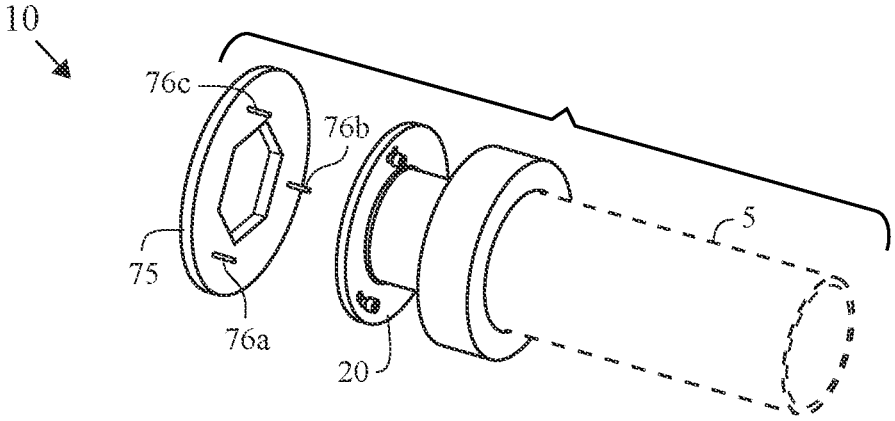
FIG. 7C is a top perspective exploded view of a tailpipe filter.

FIG. 7A-7C illustrate one mechanism for removing the filter body 25 from a tailpipe 5 utilizing an unlocking tool 75. The unlocking tool has pins 76*a*-76*c* extending from an internal surface. The pins 76*a*-76*c* of the unlocking tool 75 are aligned with holes in the front flange 20. The unlocking tool 75 is pressed against the front flange 20 to depress the spring clips. The unlocking tool is turned counter-clockwise to unlock the filter body 25 from the locking collar 30 using the twist lock mechanism. The filter body 25 is then removed from the tailpipe. The unlocking tool 75 may also have a hexagon shapes aperture for engaging with the rear filter cover 40 (not shown).

Figure 7D:
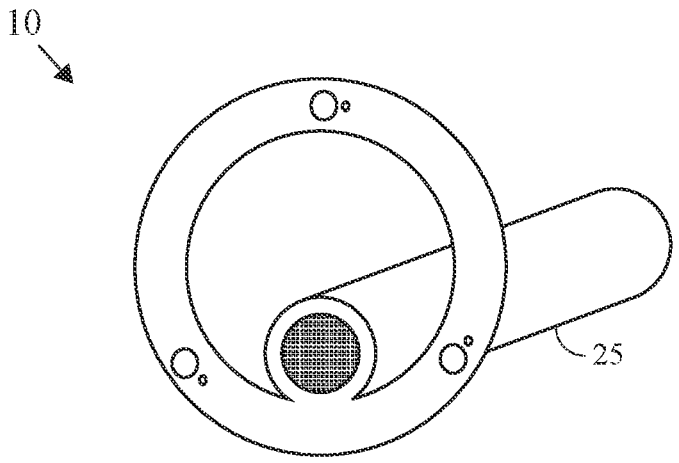
FIG. 7D is a top perspective view of an alternative embodiment of a tailpipe filter.
Figure 7E:
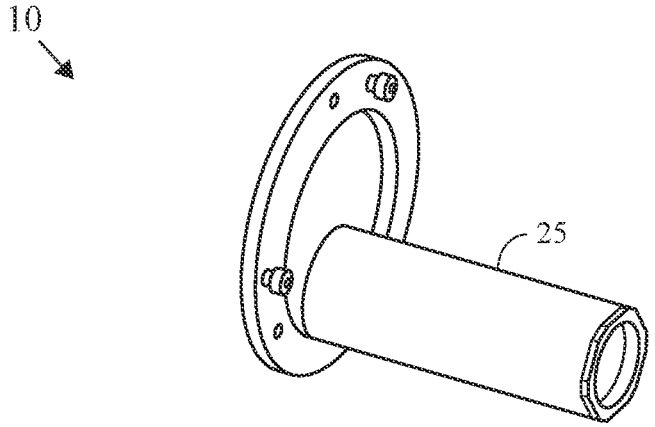
FIG. 7E is a top perspective view of an alternative embodiment of a tailpipe filter.
Figure 7F:
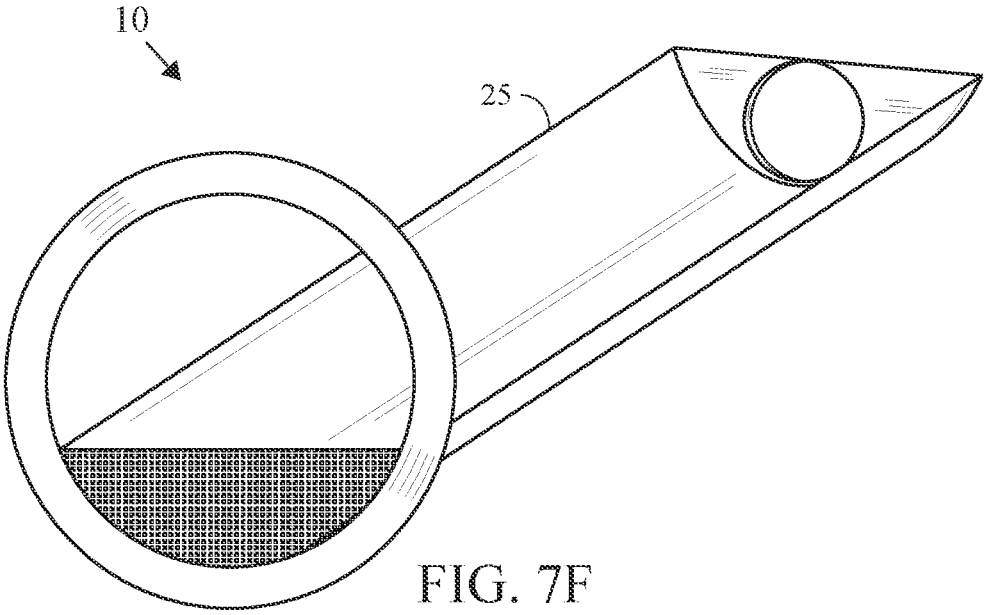
FIG. 7F is a top perspective view of an alternative embodiment of a tailpipe filter.

FIGS. 7D-7F illustrate alternative embodiments of a filter body 25.

Figure 8A:
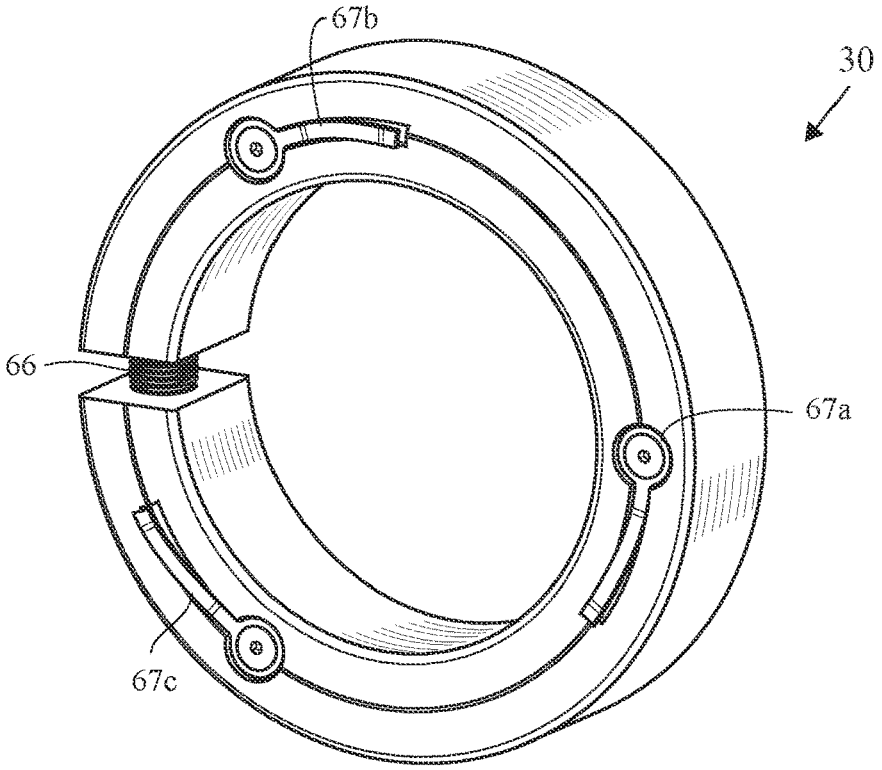
FIG. 8A is an isolated top perspective view of a first embodiment of a collar for a tailpipe filter.
Figure 8B:
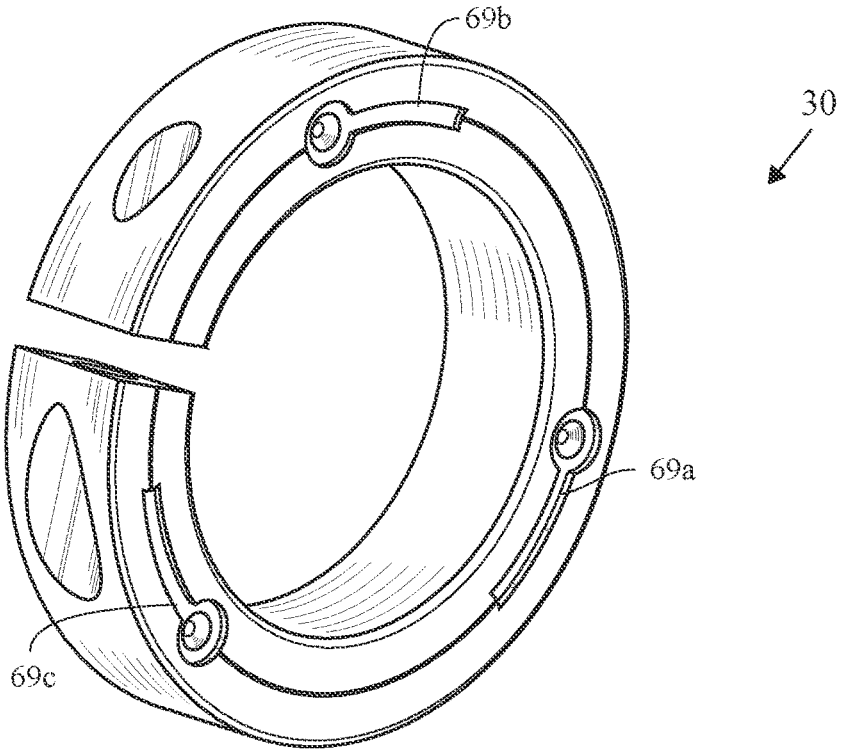
FIG. 8B is an isolated top perspective view of a first embodiment of a collar for a tailpipe filter.

FIGS. 8A and 8B illustrate a locking collar 30. FIG. 8A shows the spring locking clips 67*a-c* and the clamp screw 66. FIG. 8B shows the twist lock slots 69*a-c* without the locking clips 67*a-c* and clamp screw 66 in place.

Figure 9A:
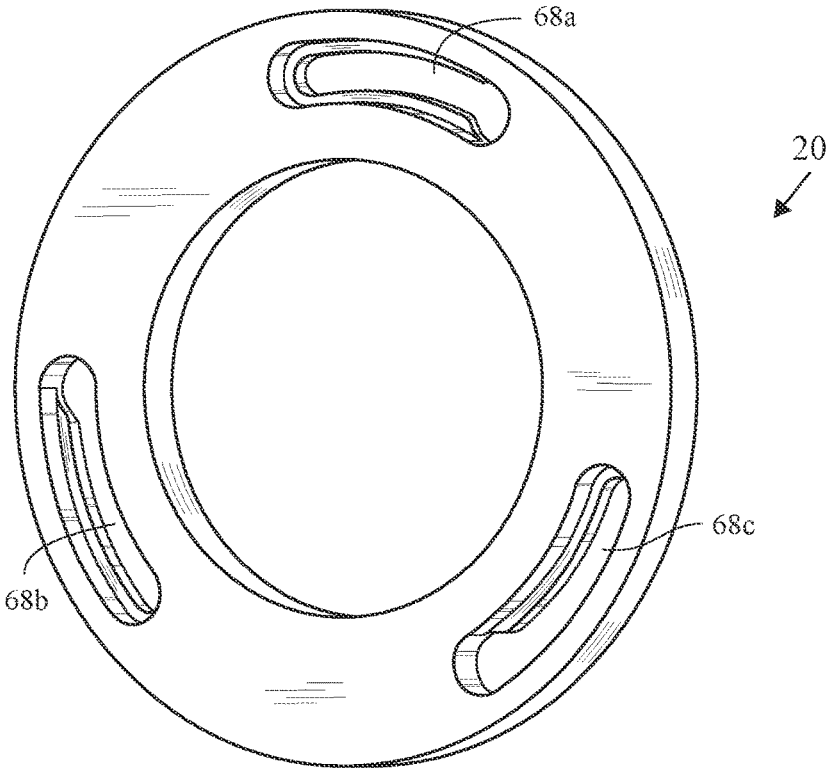
FIG. 9A is an isolated top perspective view of a front filter flange for a tailpipe filter.
Figure 9B:
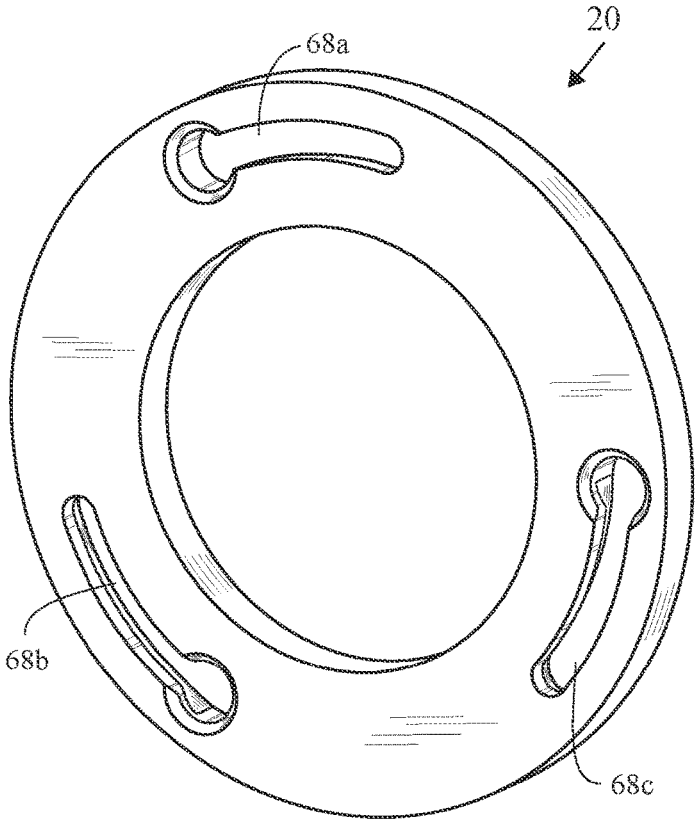
FIG. 9B is an isolated top perspective view of a front filter flange for a tailpipe filter.

FIGS. 9A and 9B illustrate the front side and the back side of a front filter flange 20 with locking clots 68*a-c*.

Figure 10A:
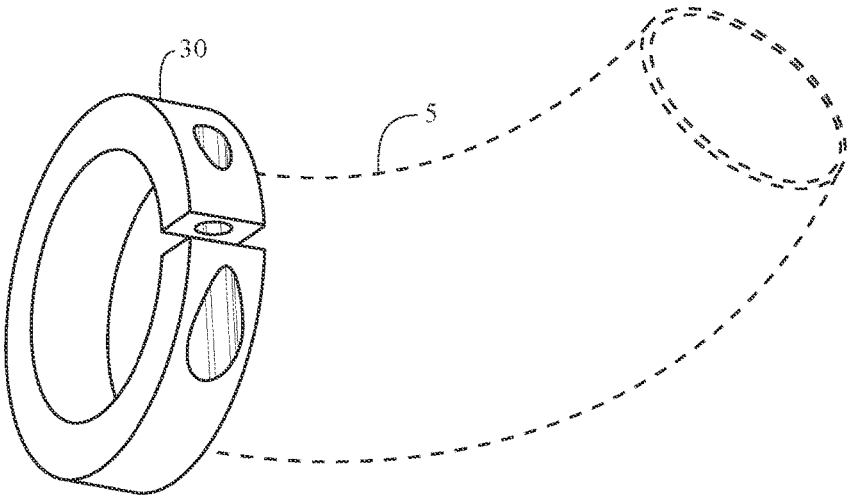
FIG. 10A is an isolated view of a collar positioned over a tailpipe extension.

FIG. 10A illustrates the locking collar 30 positioned over a tailpipe 5.

Figure 10B:
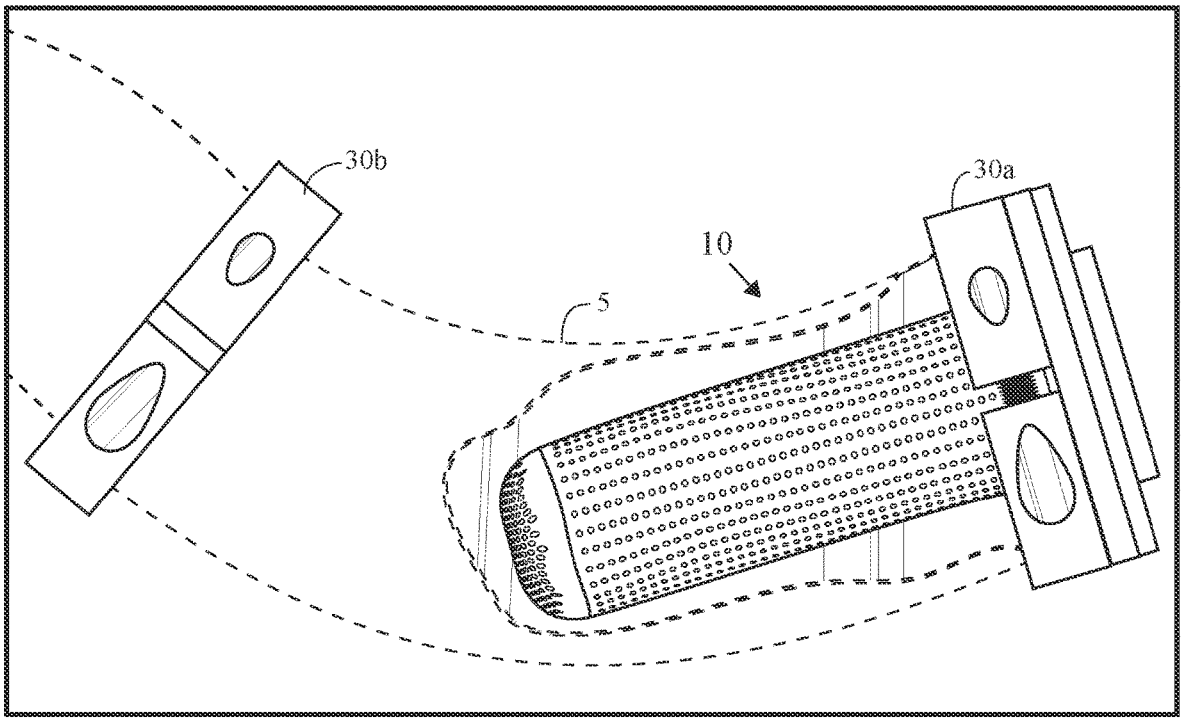
FIG. 10B is a partial cross-sectional view of a collar positioned on a tailpipe with a tailpipe extension with a mesh body removable filter medium.
Figure 11A:
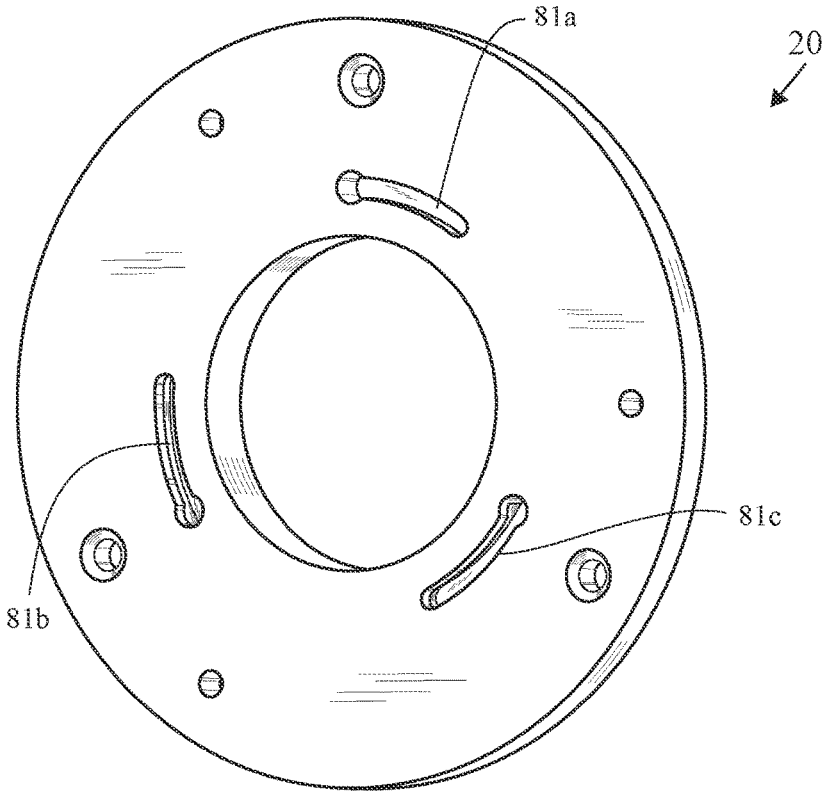
FIG. 11A is an isolated top perspective view of locking flange for a tailpipe filter.
Figure 11B:
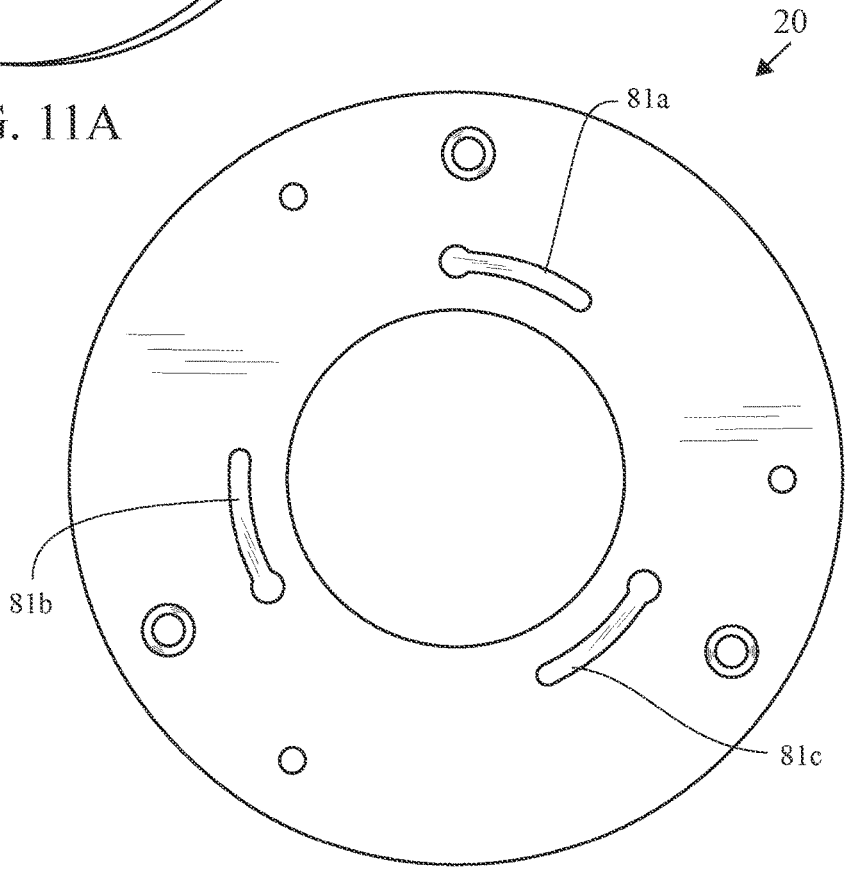
FIG. 11B is an isolated front elevation view of a locking flange for a tailpipe filter.
Figure 11C:
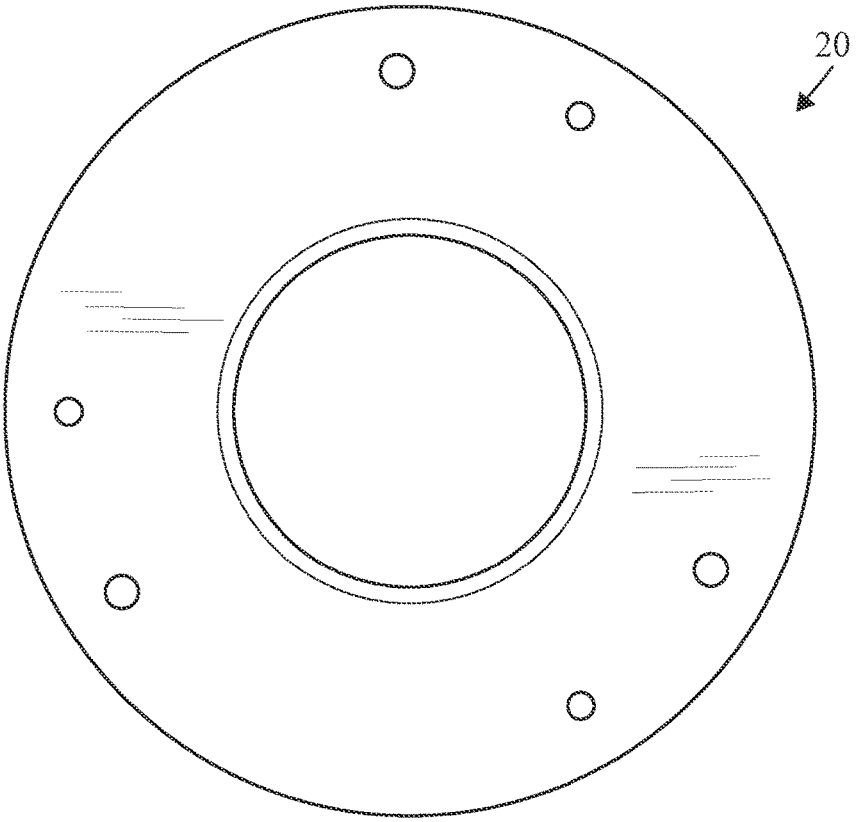
FIG. 11C is an isolated front elevation view of locking flange for a tailpipe filter.
Figure 11D:
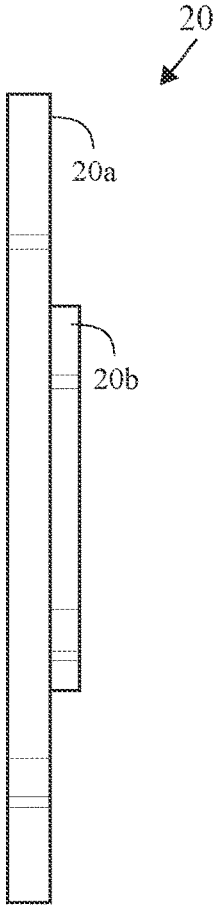
FIG. 11D is an isolated side elevation view of locking flange for a tailpipe filter.
Figure 12A:
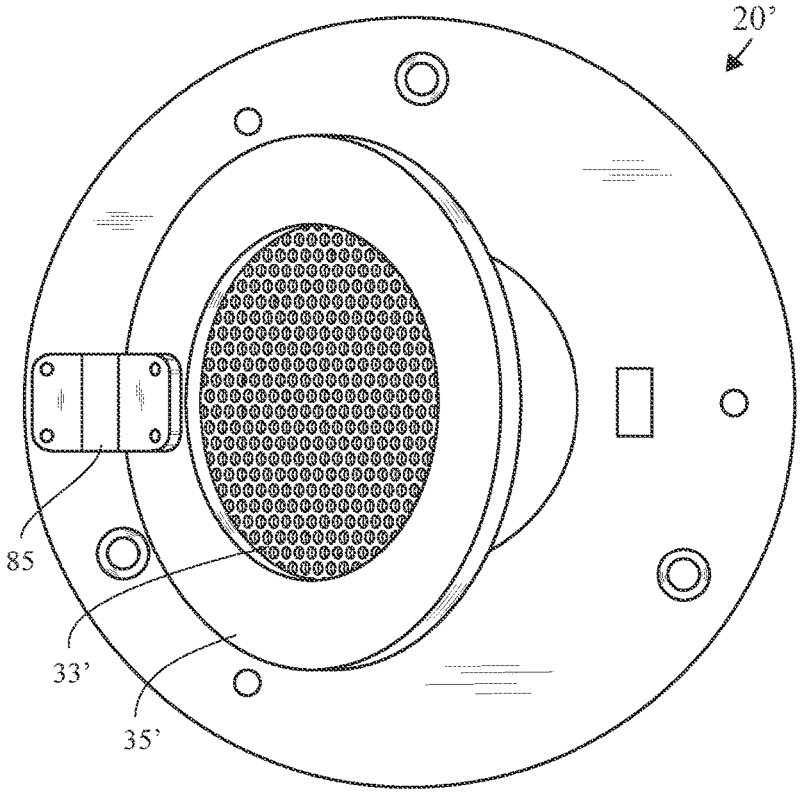
FIG. 12A is an isolated top perspective view of flange and screen for a tailpipe filter.
Figure 12B:
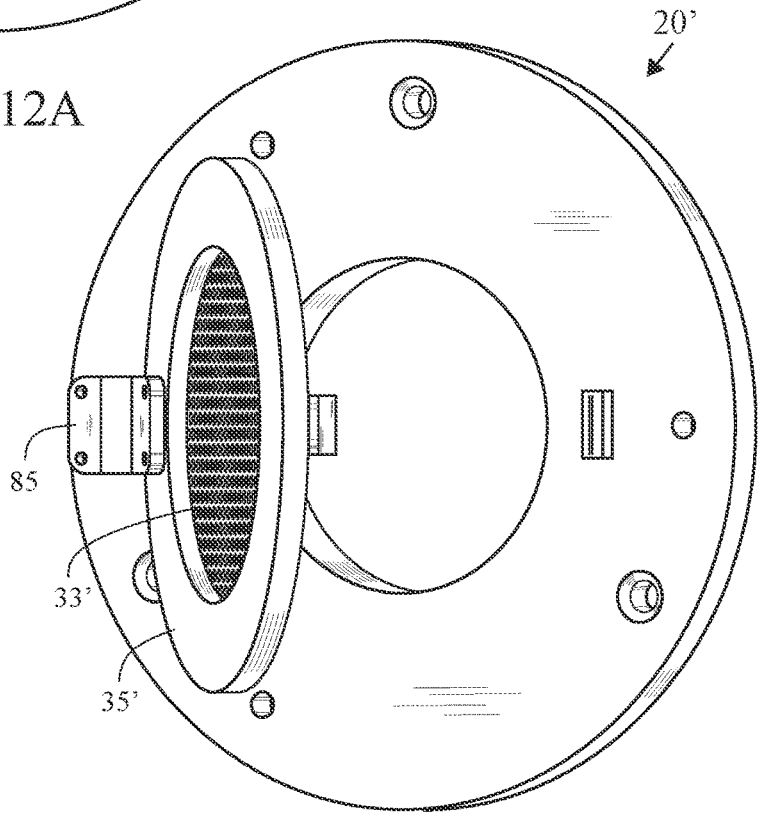
FIG. 12B is an isolated top perspective view of a flange and screen for a tailpipe filter.
Figure 12C:
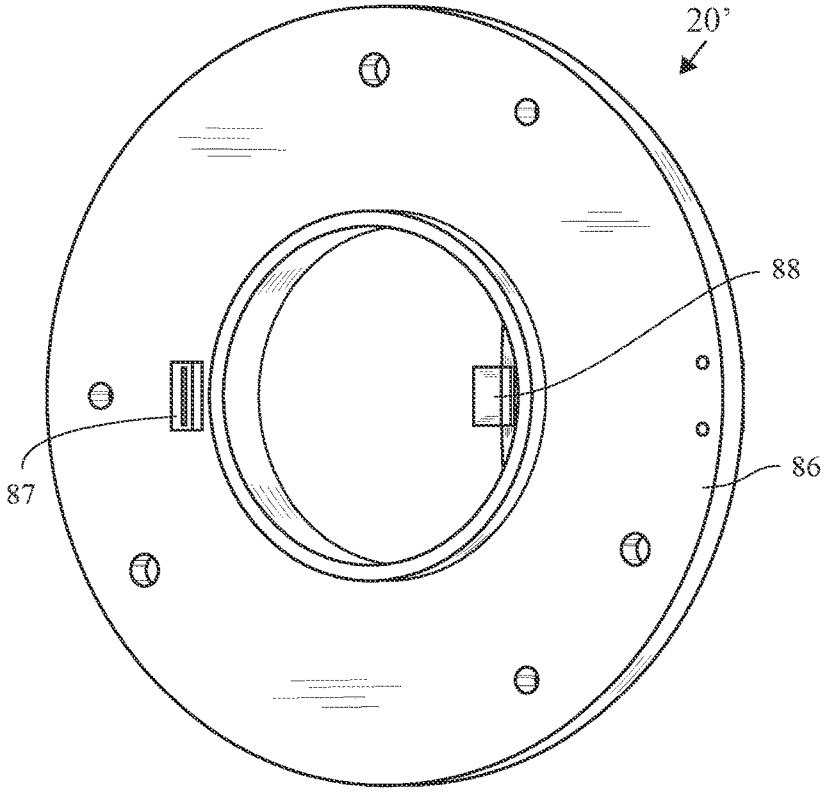
FIG. 12C is an isolated rear elevation view of a flange and screen for a tailpipe filter.
Figure 12D:
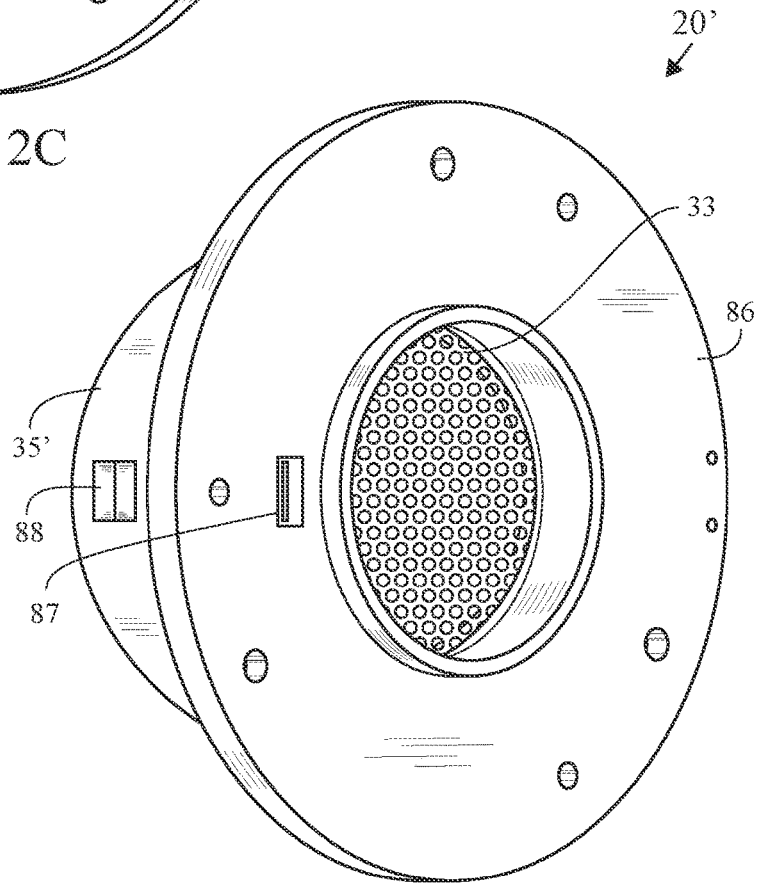
FIG. 12D is an isolated rear elevation view of a flange and screen for a tailpipe filter.
Figure 12E:
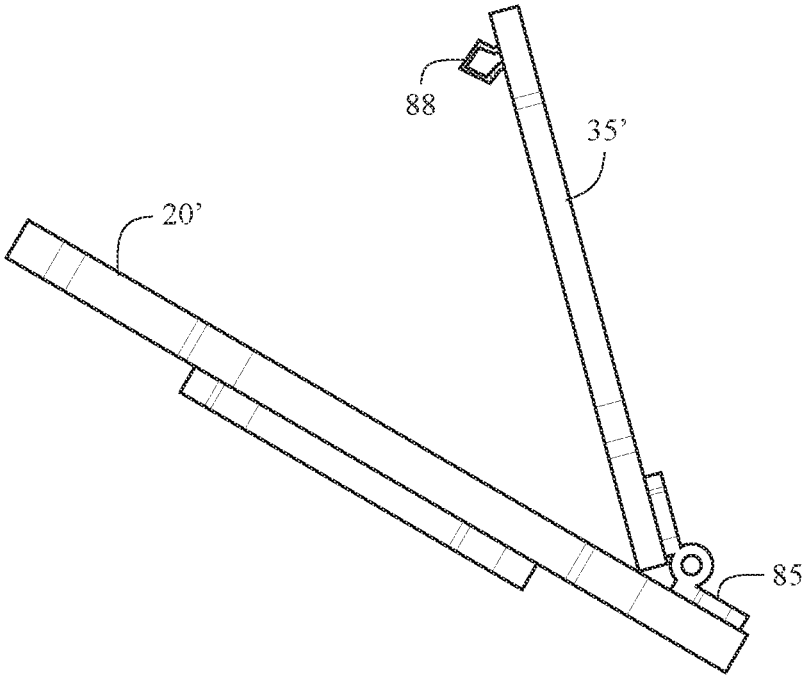
FIG. 12E is a side elevation view of a flange and screen for a tailpipe filter.

FIG. 10B illustrates locking collars 30*a* and 30*b* positioned on a tailpipe 5 with a filter body 25 within the tailpipe 5.

FIGS. 11A-11D illustrate a front locking flange 20 having a main body 20*a* and a minor body 20*b* with locking slots 81*a-c*.

FIGS. 12A-12E illustrate a front flange 20' with a hinged front cover 35'. The front cover 35' is on a hinge 85 with a perforated screen 33' (not shown), and the front cover 35' has a locking member 88.

The locking collar 30 preferably has a diameter ranging from 1 to 7 inches.

The apparatus 10 preferably has a mass ranging from 0.5 to 25 pounds, and most preferably 1 to 25 pounds.

The filter body 25 is preferably composed of an aluminum material, a steel material, stainless steel, or any material deemed eligible for this application. The filter body 25 preferably has a thickness ranging from 0.1 to 0.5 inch, and most preferably 0.125 to 0.25 inch. The filter body preferably has a length ranging from 1 to 24 inches, and most preferably 3 to 7 inches. The filter body preferably has a diameter of 1 to 7 inches, and most preferably 1 to 4 inches.

The filter medium preferably comprises of any materials that are deemed by the scientific community as sorbents that are capable of absorbing exhaust gases (such as carbon dioxide, nitrogen oxides, carbon monoxide, sulfur dioxide, particulate matter, or other hydrocarbons), such as: zeolitic imidazole frameworks, zeolites, metal organic frameworks (MOFs), other hybrid ultraporous materials, membranes, adsorption focused materials, other natural sorbents or adsorbents. Any salt containing: Li, Na, K, Cs, Rb, Fr, Ca, Mg, Be, Sr and Ba. Salts considered for this applications correspond to any alkali and alkaline earth element and: OH(—), NO3(-), SO3(-), SO4(2-), CO3(2-), CN(—), PO3(2-), CH3COO(—), PO4(3-), HPO4(2-), H2PO4(-), HCO3(-) and S(2-).

Any materials that are deemed by the scientific community as sorbents that are capable of absorbing exhaust gases (such as carbon dioxide, nitrogen oxides, carbon monoxide, sulfur dioxide, particulate matter, or other hydrocarbons), such as: zeolitic imidazole frameworks, zeolites, metal organic frameworks (MOFs), other hybrid ultraporous materials, membranes, adsorption focused materials, other natural sorbents or adsorbents. Any salt containing: Li, Na, K, Cs, Rb, Fr, Ca, Mg, Be, Sr and Ba. Salts considered for this applications correspond to any alkali and alkaline earth element and: OH(—), NO3(-), SO3(-), SO4(2-), CO3(2-), CN(—), PO3(2-), $CH_3COO$(—), PO4(3-), HPO4(2-), H2PO4(-), HCO3(-) and S(2-).

Figure 13:
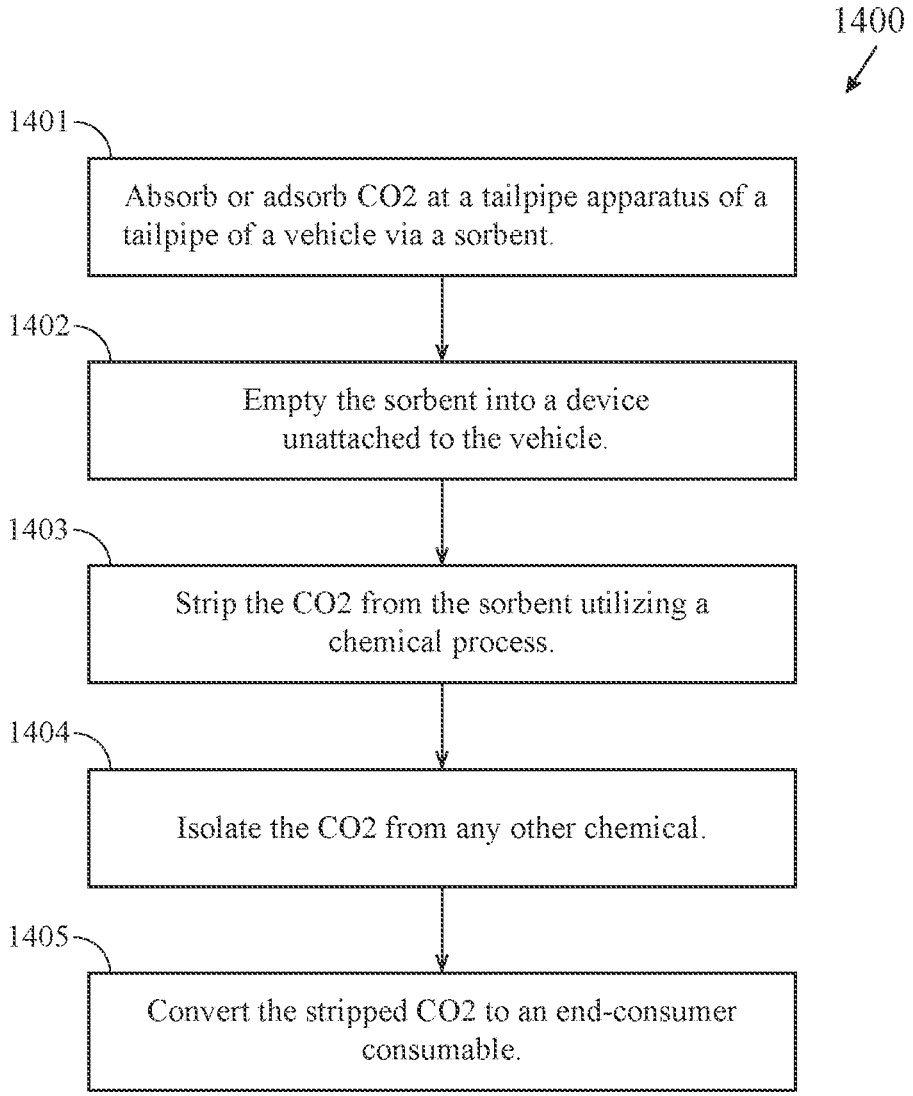
FIG. 13 is a flow chart of a method for CO2 sorption to conversion for end-consumer consumable.

As shown in FIG. 13, a method for CO2 absorption to conversion for end-consumer consumable is generally designated 1400. At block 1401, CO2 is absorbed or adsorbed at a tailpipe apparatus of a tailpipe of a vehicle via a sorbent. At block 1402, the CO2 is stripped from the sorbent utilizing a chemical process. At block 1403, the stripped CO2 is converted to an end-consumer consumable. In one example, a sorbent is placed within an initial compartment of a CO2 conversion device not attached to the light duty vehicle. The sorbent undergoes a CO2 stripping process wither via high/low temperature and/or high/low pressure, and/or electrochemical, and/or chemical applications to strip the CO2 from the sorbent. There is preferably a dispensable component that can dispense the CO2 free sorbent from the device back into the tailpipe apparatus. There is preferably a side water cartridge compartment in the device to add water to possibly aid in the CO2 stripping process. As the CO2 is released from the sorbent, excess molecules such as water either flow back to the water cartridge compartment or flow to a membrane compartment. The isolated CO2 gas travels to an electrochemical membrane which can convert the CO2 into ethanol. The reaction will preferably create ethanol and CO2, which will preferably be filtered so the CO2 will continuously cycle through the membrane until converted into ethanol. The ethanol preferably drips into a multi-gallon removable compartment that is preferably used to refuel vehicles.

Figure 14A:
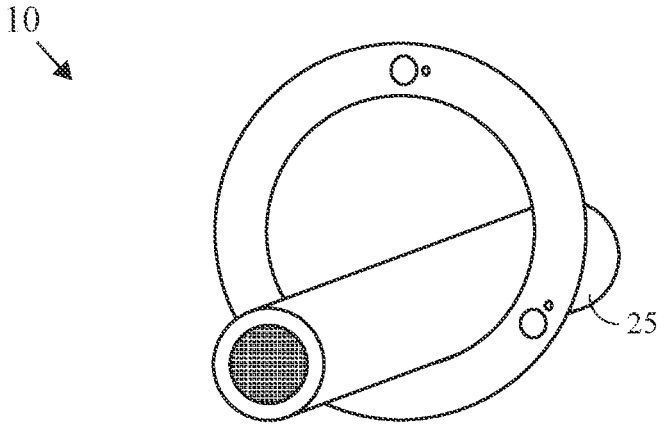
FIG. 14A is a top perspective view of an alternative embodiment of a tailpipe filter.
Figure 14B:
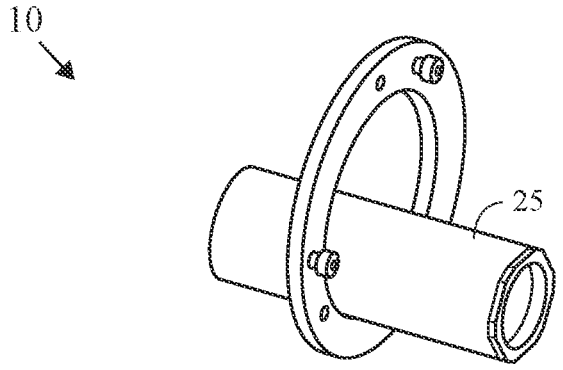
FIG. 14B is a top perspective view of an alternative embodiment of a tailpipe filter.
Figure 14C:
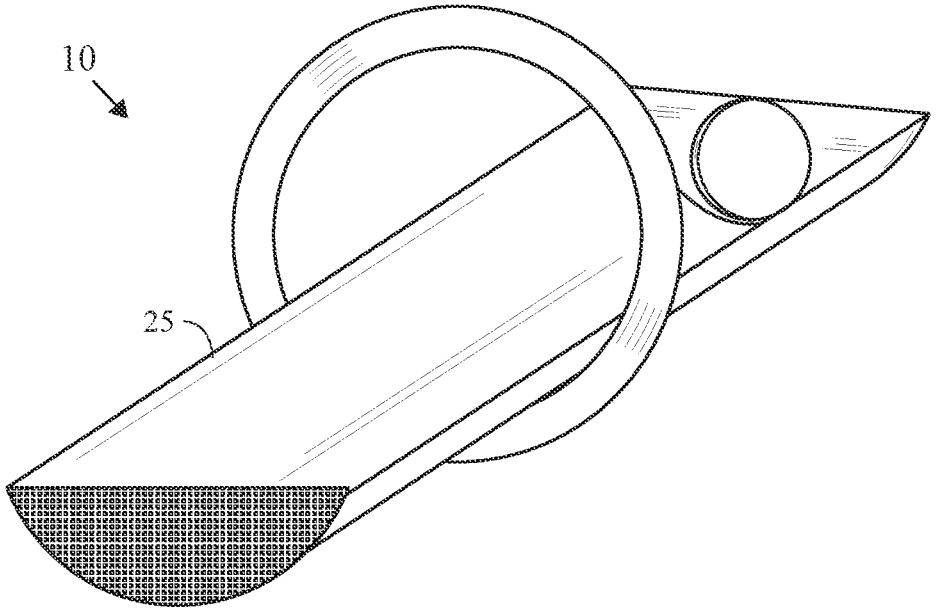
FIG. 14C is a top perspective view of an alternative embodiment of a tailpipe filter.

FIGS. 14A-14C illustrate alternative embodiments of a filter body 25.

Figure 15A:
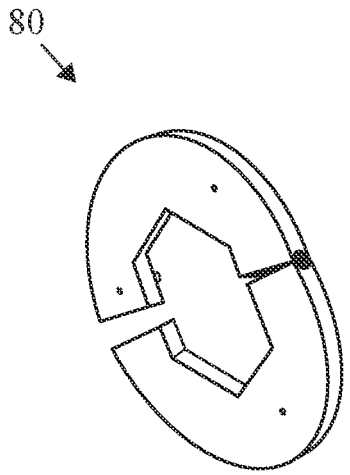
FIG. 15A is an isolated front perspective view of an unlocking tool.
Figure 15B:
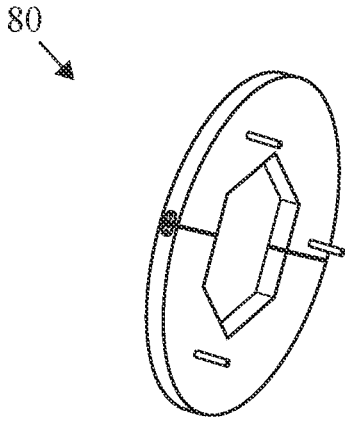
FIG. 15B is an isolated rear perspective view of an unlocking tool.
Figure 15C:
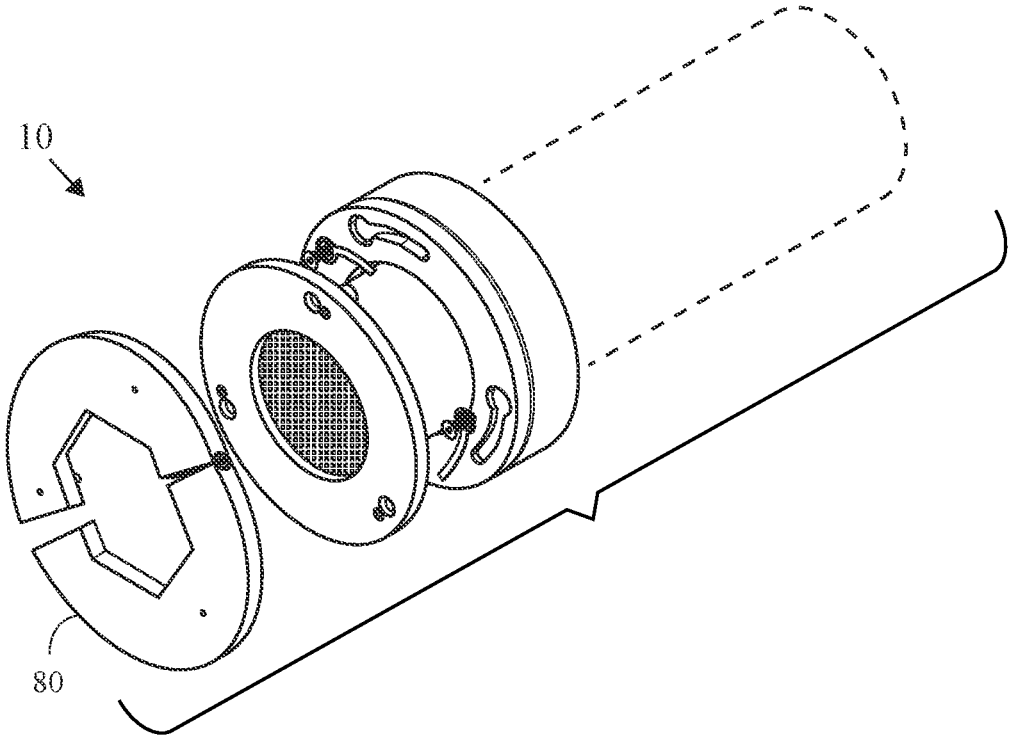
FIG. 15C is a top perspective exploded view of a tailpipe filter.

FIG. 15A-15C illustrate an alternative mechanism for removing the filter body 25 from a tailpipe 5 utilizing an unlocking tool 80. The unlocking tool 80 has pins extending from an internal surface. The pins of the unlocking tool 80 are aligned with holes in the front flange 20. The unlocking tool 80 is pressed against the front flange 20 to depress the spring clips. The unlocking tool is turned counter-clockwise to unlock the filter body 25 from the locking collar 30 using the twist lock mechanism. The filter body 25 is then removed from the tailpipe.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

I claim:

1. An apparatus for attachment to a tailpipe of a vehicle, the apparatus comprising: a filter body comprising a front flange with an aperture and an elongated section configured for insertion into the tailpipe, wherein the filter body has a thickness ranging from 0.1 to 0.5 inch, wherein the filter body has a length ranging from 1 to 24 inches, and a diameter of 1 to 7 inches;

a removable filter medium placed within the elongated section of the filter body;

a locking collar configured for placement on an exterior of the tailpipe; and a removable front cover positioned over the aperture of the front flange of the filter body;

wherein the filter body is secured to the tailpipe by connection of the front flange to the locking collar;

wherein exhaust from a tailpipe is absorbed or adsorbed by the filter medium;

wherein a mass of the apparatus ranges from 1 to 25 pounds.

2. The apparatus according to claim 1 wherein the filter body is composed of an aluminum material, steel or a stainless steel.

3. The apparatus according to claim 1 wherein the locking collar has a diameter ranging from 1 to 7 inches.

4. The apparatus according to claim 1 wherein the filter medium comprises a material selected from the group consisting of sorbents, zeolitic imidazolate frameworks, adsorption materials, zeolites, metal organic frameworks, hybrid ultraporous materials, membranes or salts.

5. The apparatus according to claim 1 wherein the filter medium comprises an electrochemical catalytic site coated onto the filter body or the filter medium.

6. The apparatus according to claim 1 further comprising a decorative tip configured to be positioned over the tailpipe.

7. The apparatus according to claim 6 wherein the decorative tip has a rectangular front cross-section.

8. The apparatus according to claim 7 wherein the removable front cover has a rectangular front cross-section.

9. The apparatus according to claim 1 wherein the elongated section is composed of a metal mesh.

10. The apparatus according to claim 1 wherein the removable front cover is secured to the front flange through a twist lock mechanism.

11. An apparatus for attachment to a tailpipe of a vehicle, the apparatus comprising: a filter body comprising a front section with an aperture, an elongated section configured for insertion into the tailpipe, and a rear cover attached to an interior end of the elongated section, wherein the filter body has a thickness ranging from 0.1 to 0.5 inch, wherein the filter body has a length ranging from 1 to 24 inches, and a diameter of 1 to 7 inches;

a removable filter medium placed within the elongated section of the filter body;

a collar configured for placement on an exterior of the tailpipe; and a removable front cover positioned over the aperture of the front section of the filter body;

wherein the filter body is secured to the tailpipe by connection of the front section to the collar;

wherein exhaust from a tailpipe is absorbed or adsorbed by the filter medium;

wherein a mass of the apparatus ranges from 1 to 25 pounds.

12. The apparatus according to claim 1 wherein the filter medium comprises a metal coated onto the filter body or the filter medium.

13. The apparatus according to claim 11 wherein the filter body is composed of an aluminum material, steel or a stainless steel.

14. The apparatus according to claim 11 wherein the collar has a diameter ranging from 1 to 7 inches.

15. The apparatus according to claim 11 wherein the filter medium comprises a material selected from the group consisting of sorbents, zeolitic imidazolate frameworks, adsorption materials, zeolites, metal organic frameworks, hybrid ultraporous materials, membranes or salts.

16. The apparatus according to claim 11 further comprising a decorative tip configured to be positioned over the tailpipe.

17. The apparatus according to claim 16 wherein the decorative tip has a rectangular front cross-section.

18. The apparatus according to claim 17 wherein the removable front cover has a rectangular front cross-section.

19. The apparatus according to claim 11 wherein the elongated section is composed of a metal mesh.

20. The apparatus according to claim 11 wherein the removable front cover is secured to the front section through a twist lock mechanism.

21. The apparatus according to claim 11 wherein the outer layer that comes in contact with the tail pipe, is made out of electrothermal material and wherein this electrothermal material is layered with a material capable to interact with the greenhouse gases it comes into contact with.

22. The apparatus according to claim 11 wherein the collar has a square shape.

* * * * *